US005360353A

United States Patent [19]

Kinoshita

[11] Patent Number: 5,360,353

[45] Date of Patent: Nov. 1, 1994

[54] CONNECTOR

[75] Inventor: Hironobu Kinoshita, Nagaokakyo, Japan

[73] Assignee: Murata Manufacturing Co., Ltd., Nagaokakyo, Japan

[21] Appl. No.: 100,150

[22] Filed: Aug. 2, 1993

[30] Foreign Application Priority Data

Aug. 28, 1992 [JP] Japan ..... 4-229523

[51] Int. Cl.[5] ..... H01R 13/66

[52] U.S. Cl. ..... 439/620; 439/72

[58] Field of Search ..... 439/607, 620, 72

[56] References Cited

U.S. PATENT DOCUMENTS 4,326,765 4/1982 Brancaleone ..... 439/620 X
4,772,224 9/1988 Talend ..... 439/607
4,772,225 9/1988 Ulery ..... 439/620
5,069,641 12/1991 Sakamoto et al. ..... 439/620

*Primary Examiner*—Eugene F. Desmond
*Attorney, Agent, or Firm*—Burns, Doane, Swecker & Mathis

[57] ABSTRACT

A concave portion is formed on a surface of a connector body, and each end of first contact terminals and each end of second contact terminals are extended respectively to mutually opposite walls of the concave portion. When a countermeasure against EMI is necessary, an array which contains filters is fitted to the concave portion to insert the filters between the first contact terminals and the second contact terminals. When the countermeasure against EMI is not necessary, a conductive array which contains conductive lines is fitted to the concave portion instead of the filter array.

6 Claims, 5 Drawing Sheets

CONNECTOR

BACKGROUND OF THE INVENTION

1. Field of the Invention

The present invention relates to a connector, and more particularly to a connector which relays a high-frequency signal.

2. Description of Related Art

Recently, in the art of electronic machines, a countermeasure against EMI (electromagnetic interference) has been an important issue. For example, when a printed circuit board in a machine is connected with a cable which is led from another machine, an electromagnetic noise may be radiated to the inside and outside of the machine through the cable which functions as an antenna. In order to solve this problem, a filter (an inductor and/or a capacitor) for preventing EMI is provided on the printed circuit board around such connector. However, making a filter fitting space on the printed circuit board prevents a down-sizing of machine, which is strongly requested today.

SUMMARY OF THE INVENTION

An object of the present Invention is to provide a connector which prevents EMI without a filter fitting space provided on the printed circuit board.

In order to attain the object, a connector according to the present invention: has a concave portion on a surface of a connector body which is made of an insulating material; extends an end of a first contact terminal to a wall of the concave portion; extends an end of second contact terminal to the other side of wall of the concave portion; and connects the first and the second contact terminals electrically through a conductive passive element which is fitted in the concave portion.

In the above structure, when a countermeasure against EMI is necessary, a filter element which contains an inductor, a capacitor or a resistor is fitted in the concave portion of the connector body. The first and the second contact terminals are connected electrically through the filter element in the concave portion. Also, a penetration of the electromagnetic noise is prevented by the filter element. On the other hand, when the countermeasure against EMI is not necessary, a conductive element which only connects the first and the second terminals electrically is fitted in the concave portion instead of the filter element.

In the present invention, the countermeasure against EMI can be provided when it is necessary by fitting the filter element in the connector body and a filter element fitting space does not need to be provided on the printed circuit board. As the filter element, either an inductor, a capacitor or a resistor can be used, and also, these can be either a chip type or an array type. Further, since the filter element is fitted in tile connector body, the filter element is protected from stress caused by deflection of the printed circuit board. If the filter element is fitted directly on tile circuit board, a crack may occur on the filter element by deflection of the circuit board and a noise eliminating function may be lost. However, this will not occur in the present invention.

BRIEF DESCRIPTION OF THE DRAWINGS

This and other objects and features of the present invention will become apparent from the following description with reference to tile accompanying drawings, in which.

DETAILED DESCRIPTION OF THE PREFERRED EMBODIMENTS

The description of preferred embodiments according to the present invention is given below, referring to the accompanying drawings.

Figure 1:
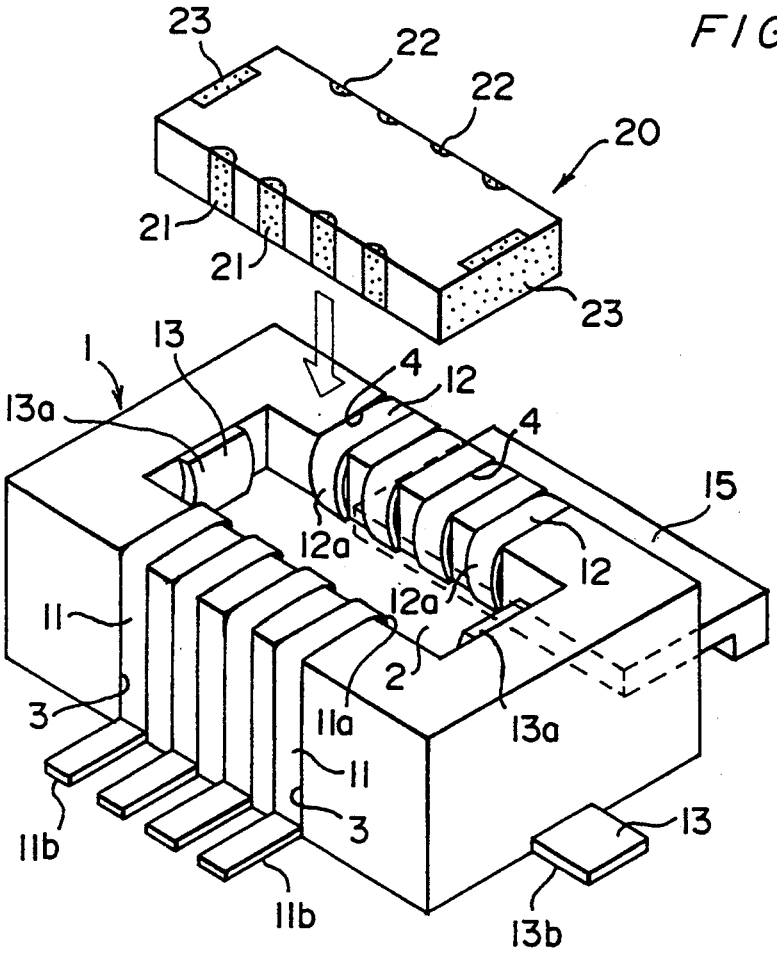
FIG. 1 is an exploded perspective view which shows a connector which is a first embodiment of the present invention.
Figure 2:
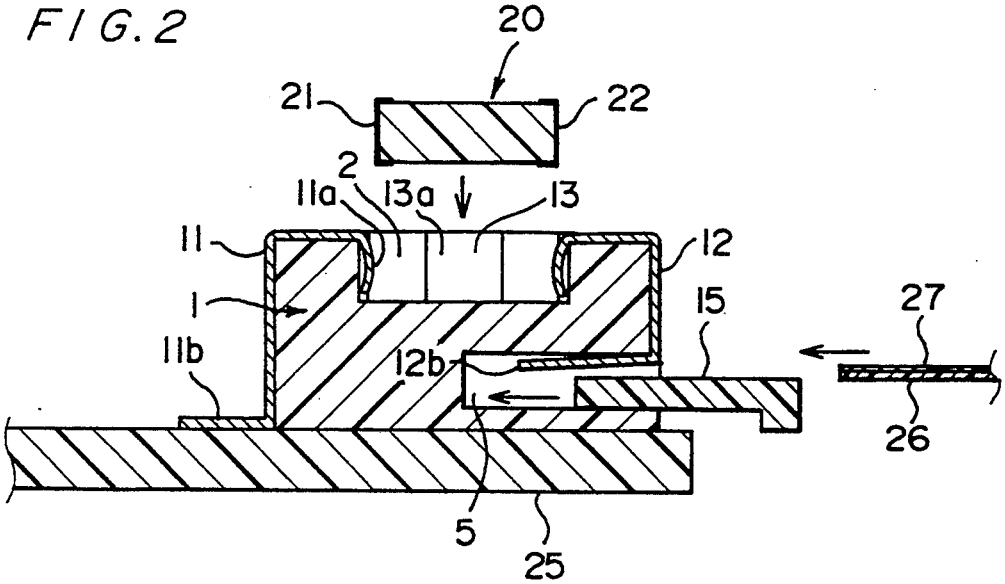
FIG. 2 is an exploded sectional view which shows the connector mounted on a printed circuit board.

First Embodiment: FIGS. 1 and 2

In FIGS. 1 and 2, numeral 1 denotes a connector body, 11 denotes first contact terminals, 12 denotes second contact terminals, 13 denotes grounding/fixing terminals, 15 denotes a connecting/fixing piece, and 20 denotes a filter array.

The connector body 1 is molded out of resin and has a concave portion 2 for fitting an element at its upper portion. The first contact terminals 11 are press-fixed to a plurality of grooves 3 which are formed from a side to a top of the connector body 1. Ends 11*a* of tile contact terminals 11 extend to a wall of the concave portion 2 and the other ends 11*b* extend horizontally at the same level as the bottom of tile connector body 1. The second contact terminals 12 are press-fixed to a plurality of grooves 4 which are formed from another side to the top of the connector body 1. Ends 12*a* of the contact terminals 12 extend to another wall of the concave portion 2 and face to the ends 11*a* of the first contact terminals 11. The other ends 12*b* extend to an opening 5 which are formed on another side of the connector body 1. The grounding/fixing terminals 13 are fixed to the connector body 1 by insert molding. Ends 13*a* a of the terminals 13 extend to walls of short sides of the concave portion 2. The other ends 13*b* extend horizontally at tile same level as the bottom of the connector body 1.

The filter array 20 is a chip type wherein four (which is the same of the number of connector lines) inductors and/or capacitors are provided. At both long sides of the filter array 20, external electrodes 21 and 22 which are connected to the inductors and/or capacitors electrically are formed. At short sides of the filter array 20, grounding electrodes 23 are formed. The filter array 20, press-fitted to tile concave portion 2 of the connector body 1. When the filter array 20 has been fitted, the external electrodes 21 are contacted with the ends 11*a* of the first contact terminals 11 with pressure, tile external electrodes 22 are contacted with the ends 12*a* of the second contact terminals 12 with pressure, and tile grounding electrodes 23 are contacted with the ends 13*a* of the grounding/fixing terminals 13 with pressure. The electrodes and the terminals mutually in contact are electrically connected. The filter array 20 is held in the concave portion 2 by the elastic ends 11*a* , 12*a* and 13*a* . The holding of the filter array 20 is ensured by soldering the electrodes 21, 22 and 23 to the terminals 11, 12 and 13.

The connector which contains the filter array 20 as explained above, as shown in FIG. 2, is mounted on a surface of a printed circuit board 25. The connector is mounted onto the circuit board 25 by soldering the ends 13*b* of the grounding/fixing terminals 13 to a grounding line (not shown) on the circuit board 25. Also, the ends 11*b* of the first contact terminals 11 are soldered to signal lines (not shown) on the circuit board 25. The second contact terminals 12 are connected with a signal cable which is led from external machines or a signal cable which is led from another circuit board in the same machine. The signal cable is, for example, formed by a plurality of signal lines 27 on a flexible base 26. The flexible base 26 is press-fitted to tile opening 5 of the connector body 1 together with the connect fixing piece 15 which is slidable in a direction to the connector body 1. The connect fixing piece 15 functions as a wedge, and the piece 15 fixes the flexible base 26 to the opening 5 and makes the signal lines 27 into contact with the ends 12*b* of the second contact terminals 12 with pressure.

Figure 3:
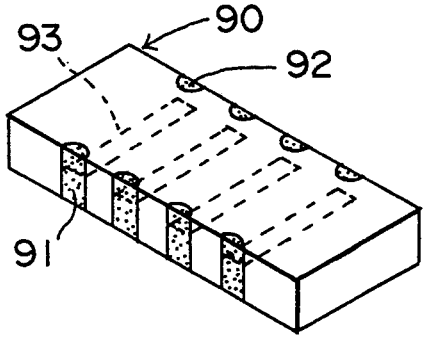
FIG. 3 is a perspective view which shows a conductive array which is set instead of a filter array shown in FIGS. 1 and 2.

In the above structure, the signal lines 27 on the flexible base 26 and the signal lines on the printed circuit board 25 are connected electrically through the contact terminals 11 and 12 and the filter elements which are contained in the filter array 20- Also, electromagnetic noise is eliminated by the filter elements. On the other hands, when the countermeasure against EMI is not necessary, a conductive array 90 shown in FIG. 3 is set in the concave portion 2. The conductive array 90 is provided with external electrodes 91 and 92 which have the same shape and the same pattern as those of the filter array 20. The conductive array 90 has conductors 93 of a high conductance in order to connect each contact terminals 11 and 12 electrically. The number of conductors 93 is The same as tile number of connector lines.

In the first embodiment, the countermeasure against EMI can be obtained by installing the filter array 20 in the concave portion 2 formed on the connector body 1. When the countermeasure against EMI is not necessary, the conductive array 90 is fitted in the concave portion 2. Thus, the necessity of providing a space for the filter elements on the printed circuit 25 can be eliminated, and no crack which is caused by deflection of the circuit board 25 occurs on the filter array 20. In the first embodiment, the shapes of the contact terminals 11 and 12 and the grounding/fixing terminals 13, the fixing method to the connector body 1 or the connecting method of tile contact terminals 12 and other circuits are optional. Also. the filter array 20 may have any other structure according to a necessary countermeasure against EMI as well as the one above described.

Figure 4:
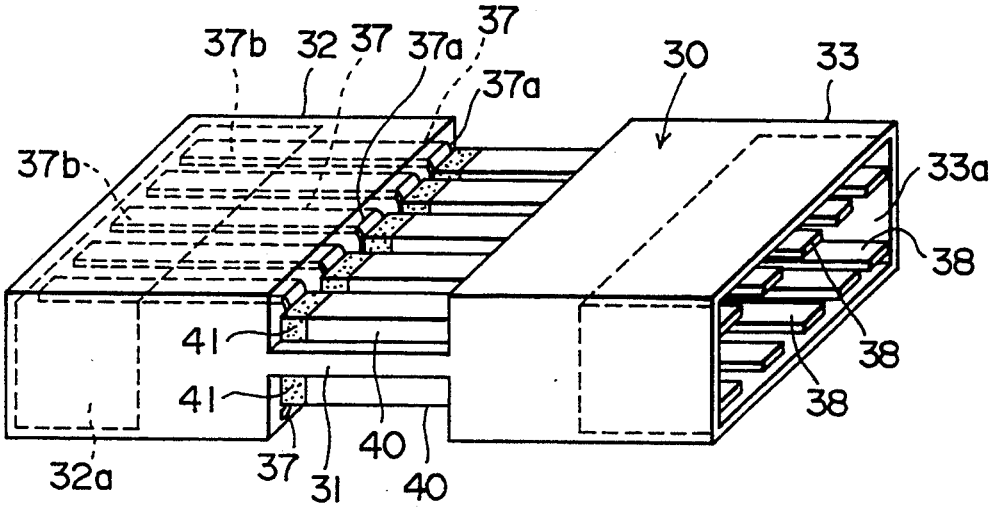
FIG. 4 is a perspective view which shows a connector which is a second embodiment of the present invention.
Figure 5:
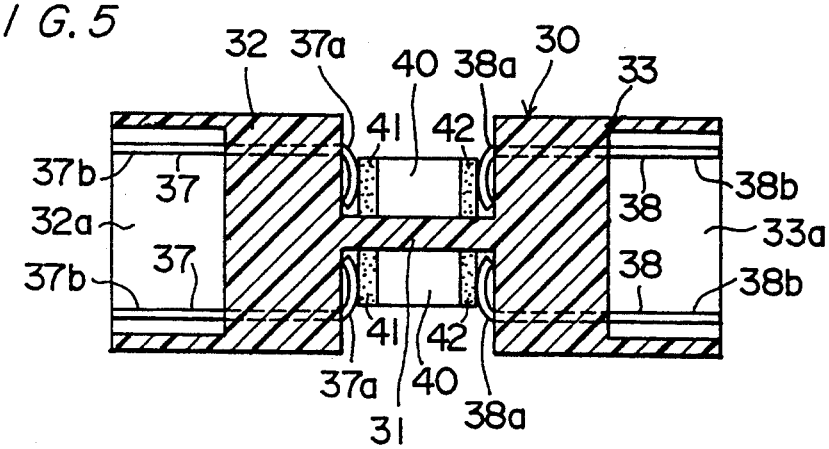
FIG. 5 is a vertical sectional view which shows the connector shown in FIG. 4.

Second Embodiment: FIGS. 4 and 5

As shown in FIGS. 4 and 5, a connector which is the second embodiment of the present invention comprises a connector body 30 which is made of an insulating material, a plurality of pairs of contact terminals 37 and 38 and a plurality of chip inductors 40. The connector body 30 has a holding portion 31 in the middle to contain the chip inductors 40. Also connecting portions 32 and 33 are provided at both sides of the holding portion 31. Openings 32*a* and 33*a* which receive inserted mating plugs are formed at the connecting portions 32 and 33.

The plurality of contact terminals 37 are insert-molded at upper and lower parts of the connecting portion 32. The ends 37*a* of the contact terminals 37 which contact with the chip inductors 40 are bent to be elastic. The other ends 37*b* are led to tile opening 32*a*.

The plurality of contact terminals 38 are insert-molded at upper and lower parts of the connecting portion 33. The ends 38*a* of tile contact terminals 38 which contact with the chip inductors 40 are bent to be elastic. The other ends 38*b* are led to the opening 33*a* . The ends 37*b* and 38*b* function as contacts to mating plugs. The contact terminals 37 and 38 are positioned facing to each other such that mutually opposite contact terminals 37 and 38 make a pair.

The chip inductors 40 are a rectangular parallelopiped 2-terminal type, and each of the inductors 40 has external electrodes 41 and 42 at both sides. Each chip inductor 40 is press-fitted between each pair of the contact terminals 37 and 38 at the upper and lower sides of the holding portion 31 by being held by the elastic ends 37*a* and 38*a* . The external terminals 41 and 42 contact with the contact terminals 37 and 38 respectively.

The connections between the external electrodes 41 and 42 of the chip inductors 40 and the ends 37*a* and 38*a* of the terminals 37 and 38 are ensured by soldering the external electrodes 41 and 42 to the ends 37*a* and 38*a* . However, the chip inductors 40 can be kept between the ends 37*a* and 38*a* without soldering. Without soldering, an operation for fitting the chip inductors 40 become easy and the chip inductors 40 are not affected by heat stress at the time of soldering.

In this connector, the ends 37*b* and 38*b* of the contact terminals 37 and 38 are connected with mating plugs. Then a high frequency noise which penetrates into the connector is eliminated by the chip inductors 40. When the chip inductors 40 have a high inductance, the connector obtains a high impedance value and eliminates the noise more effectively, compared with a connector using ferrite beads. Also, since a capacitor is not used in this connector, even though the connector is applied to an electric machine which is not provided with sufficient ground, a stabilized noise eliminating effect can be obtained.

On the other hand, when the countermeasure against EMI is not necessary, chip conductors are provided instead of the chip inductors 40. The chip conductors (not shown) have the same shape as tile chip inductors 40.

Also, as the filter, the array type inductor described in the first embodiment can be used instead of the chip type inductors 40.

Figure 6:
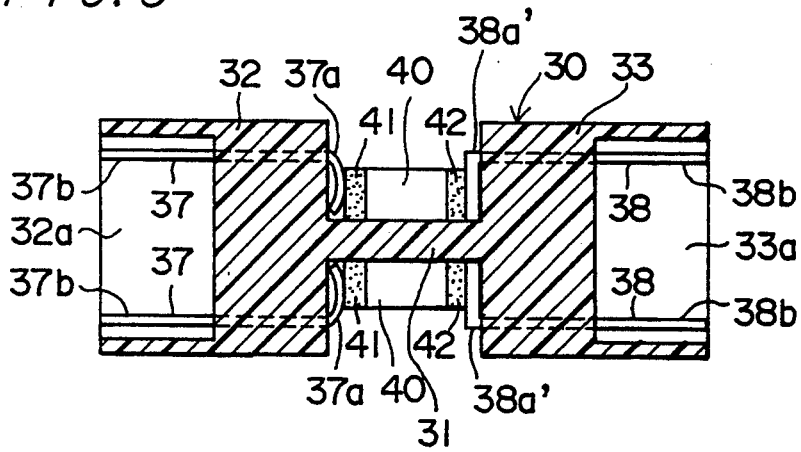
FIG. 6 is a vertical sectional view which shows a connector which is a third embodiment of the present invention.

Third Embodiment: FIG. 6

As shown in FIG. 6, a connector which is the third embodiment has basically the same structure as the second embodiment. Thus, the reference marks which have been used in FIGS. 4 and 5 are used to denote the same members in FIG. 6.

The difference between the second embodiment and the third embodiment is that, in the third embodiment, ends 38*a'* of the contact terminals 38 are bent at a right angle. Thus, tile ends 38*a'* are not elastic. The chip inductors 40 are kept between the ends 37*a* and 38*a'* of the contact terminals 37 and 38 by the elasticity of the ends 37*a*.

This connector has the same function and effect as the second embodiment.

Figure 7:
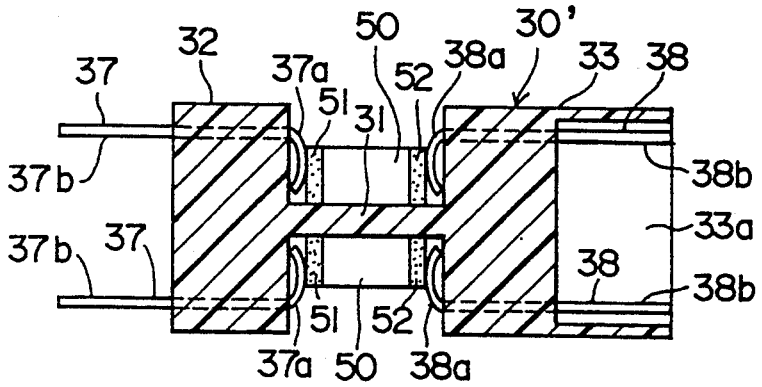
FIG. 7 is a vertical sectional view which shows a connector which is a forth embodiment of the present invention.

Forth Embodiment: FIG. 7

As shown in FIG. 7, a connector which is the forth embodiment of the present Invention is provided with a plurality of chip resistors 50as the filter. Also, an opening is eliminated from the connecting portion 32 of the connector body 30', and the ends 37*b* of the contact terminals 37 are exposed to an outside. The chip resistors 50 are a 2-terminal type, and each of the resistors 50 has external electrodes 51 and 52 at both sides. The chip resistors 50 are kept between the ends 37*a* and 38*a* of the contact terminals 37 and 38 elastically with pressure in the same manner as same as the second embodiment.

The other parts of this connector are the same as the ones described in the second embodiment, and the same reference marks are used to denote the same members. Also, this connector has the same function and effect as the second embodiment. When the countermeasure against EMI is not necessary, the chip conductors or alternatively the conductive array 90 shown in FIG. 3 is fitted instead of the chip resistors 50.

Figure 8:
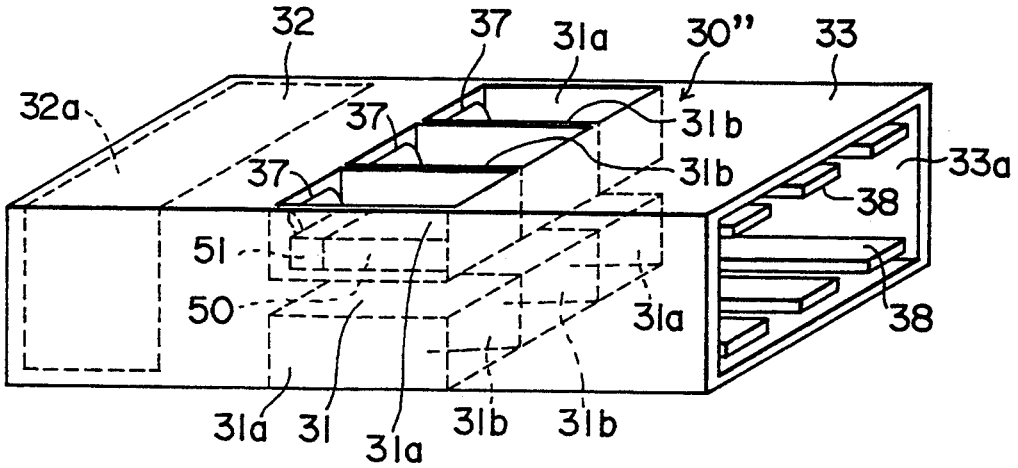
FIG. 8 is a perspective view which shows a connector which is a fifth embodiment for the present invention.

Fifth Embodiment: FIG. 8

As shown in FIG. 8, a connector which is the fifth embodiment of the present invention is provided with the chip resistors 50 described in the forth embodiment as the filter. Further, side portions 31*a* and partition portions 31*b* are provided at the holding portion 31 to form concave portions for containing the chip resistors 50 separately. With containing tile chip resistors 50 in the concave portions, the chip resistors 50 are not effected directly by an external force, and it is less likely that the resistors 50 will be mispositioned or fall. Also, the strength of the connector body 30" is improved by the side portions 31*a* and the partition portions 31*b*.

Also, the other parts of this connector are the same as the ones described in the second embodiment, and the same reference marks are used for the same members. This connector has the same function and effect as the second embodiment.

Figure 9:
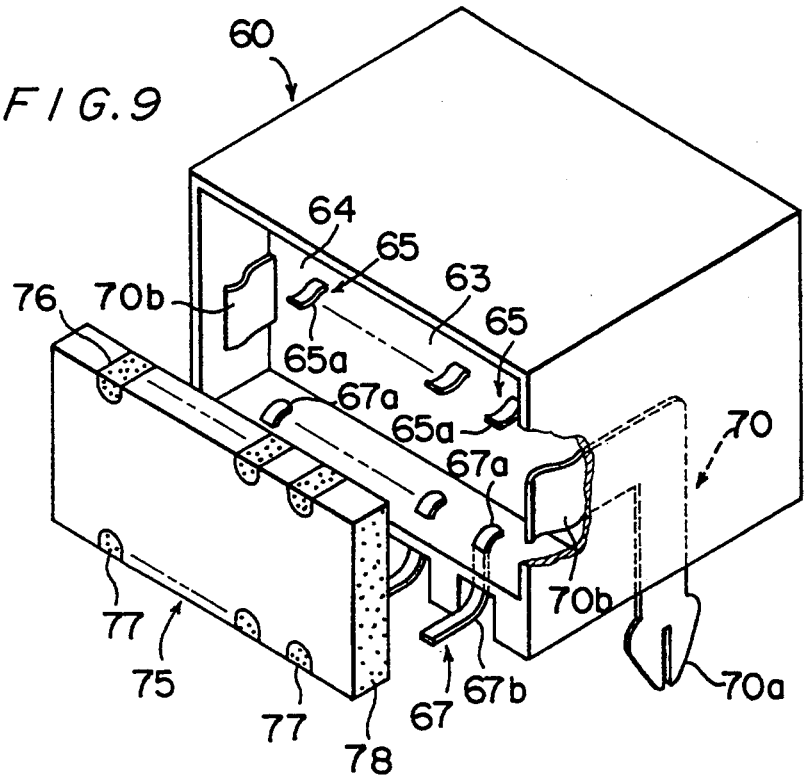
FIG. 9 is an exploded perspective view which shows a connector which is a sixth embodiment of the present invention.
Figure 10:
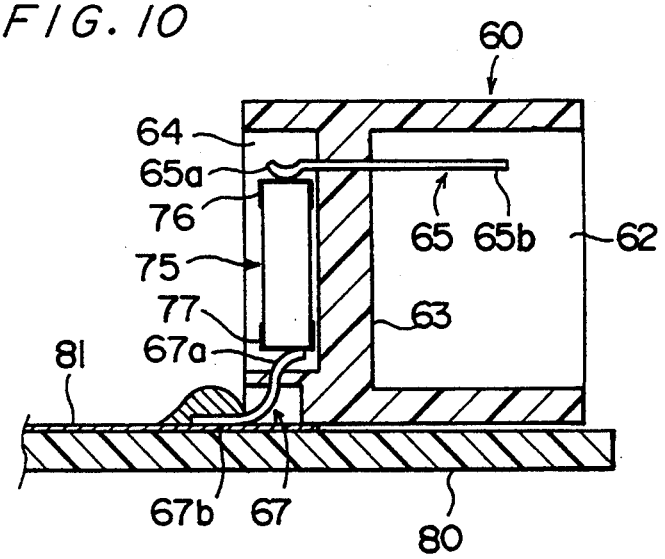
FIG. 10 is vertical sectional view which shows the connector shown in FIG. 9 mounted on a printed circuit board.

Sixth Embodiment: FIGS. 9 and 10

In FIGS. 9 and 10, a connector which is the sixth embodiment of the present invention comprises a connector body 60, contact terminals 65 and 67, grounding-/fixing terminals 70 and a 3-terminal type capacitor array 75.

The connector body 60 is molded out of insulating resin. The connector body 60 has an opening 62 and a concave portion 64 in the front and in the back with a partition wall 63 in-between. The contact terminals 65 are insert-molded to the partition wall 63. Ends 65*a* of the contact terminals 65 are protruded to the concave portion 64 and the other ends 65*b* are protruded to the opening 62. The contact terminals 67 are insert-molded at the bottom of the concave portion 64. Ends 67*a* of the contact terminals 67 face to the ends 65*a* of the contact terminals 65. The other ends 67*b* of the contact terminals 67 are led to an outside of the connector body 60 and connected with lines 81 on a printed circuit board 80 by soldering.

The grounding/fixing terminals 70 are insert-molded to side walls of the connector body 60. Ends 70*a* of the terminals 70 are protruded downward from the bottom of the connector body 60, and ends 70*b* are protruded at the both sides of the concave portion 64.

The capacitor array 75 is a known type which contains capacities. The number of the capacities is the same as the number of the pair of the contact terminals 65 and 67. Input external electrodes 76 and output external electrodes 77 are provided at long sides of the capacitor array 75. Grounding electrodes 78 are provided at both short sides. The capacitor array 75 is held at upper and bottom sides elastically by the ends 65*a* and 67*a* of the contact terminals 65 and 67 and at both sides by the ends 70*b* of the grounding/fixing terminals 70 to be contained in the concave portion 64. At this time, the external electrodes 76 are connected with the contact terminals 65, the external electrodes 77 are connected with the contact terminals 67, and the grounding electrodes 78 are connected with the grounding/fixing terminals 70. The capacitor array 75 is held by the ends 65*a* , 67*a* and 70*b* , and also connected electrically thereto. Each end 65*a* , 67*a* and 70*b* can be soldered to each electrodes 76, 77 and 78 respectively in order to ensure the connections.

The connector of the above structure, as shown in FIG. 10, is mounted on the printed circuit board 80 by soldering the ends 67*b* of the contact terminals 67 to the printed lines 81 on the circuit board 80. At this time, the ends 70*a* of the grounding/fixing terminals 70 are inserted in holes which are formed on the circuit board 80. Thus, the connector is prevented from falling from the board 80, and the grounding/fixing terminals 70 are connected with a grounding line (not shown) on the board 80.

Signals which are inputted from the contact terminals 65 are transmitted to the printed lines 81 through the capacities and the contact terminals 67. At that time, a high-frequency noise is transmitted to the grounding lines on the printed circuit board 80 through the grounding electrodes 78 and the grounding/fixing terminals 70.

On the other hand, when tile countermeasure against EMI is not necessary, the conductive array 90 shown in FIG. 3 is provided instead of the capacitor array 75.

In the sixth embodiment, as the filter, an inductor array can be used instead of the 3-terminal capacitor array 75. In this case, the grounding/fixing terminals 70 do not have to function as ground terminals. Any other passive element array, for example a resistor array, can be used instead of the capacitor array or the inductor array.

Also, the contact terminals 65 and 67 and the grounding/fixing terminals 70 need to be moderately elastic to hold the capacitor array 75. However, the shapes and the fixing method (tile insert-molding or press-fixing) to the connector body 60 are optional. This is the same in the first through the fifth embodiments.

Also, the product style is optional. The connector already installed with the array 75 in the connector body 60 may be put into the market. It is also possible to put the connector body 60 and the array 75 into the market separately. In the latter case, the user fits a capacitor array of a desirable specification into the connector body 60 when mounting.

Although the present invention has been described in connection with the preferred embodiments above, it is to be noted that various changes and modifications are apparent to a person skilled in tile art. Such changes and modifications are to be understood as being within the scope of the present invention.

What is claimed is:

1. A connector which is mounted on a printed circuit board, the connector connecting signal lines from outside the printed circuit board to conductive patterns on the printed circuit board, the connector comprising:

a connector body made of an insulating material, the connector body having a concave portion and an opening which receives external signal lines;

a plurality of first terminals provided at the connector body, one end of each first terminal being elastic and led to the concave portion, and the other end of each first terminal being led outside the connector body and connected electrically to a conductive pattern on the printed circuit board;

a plurality of second terminals which are provided at the connector body, one end of each second terminal being elastic and led to the concave portion, and the other end of each second terminal being provided at the opening and connected electrically to one of said external signal lines;

a grounding terminal which is provided at the connector body, one end of the grounding terminal being led to the concave portion, and another end of the grounding terminal being led outside the connector body and connected electrically to a ground line on the printed circuit board; and a 3-terminal capacitor array including a plurality of capacitor elements, the capacitor array having a first electrode and a second electrode for each capacitor element and a common grounding electrode, the array being press-fitted into the concave portion, the first electrode of each capacitor being connected with one of the first terminals, the second electrode of each capacitor being connected with one of the second terminals and the common grounding electrode being connected with the grounding terminal.

2. A connector for connecting signal lines which are external of a printed circuit board to conductive patterns formed on the printed circuit board, the connector comprising:

a connector body formed of insulating material, said connector body having a concave portion for receiving a filter array;

a plurality of first conductive terminals extending from a first wall within said concave portion to an exterior of said connector body for contacting conductive patterns on a printed circuit board;

a plurality of second terminals extending from a second wall within said concave portion to said exterior of said connector body for contacting external signal lines;

a grounding terminal extending from a third interior wall of the concave portion to said exterior of said connector body for electrical connection to a ground line of the printed circuit board; and a filter array having a plurality of filter elements, said filter array being press-fit into the concave portion, and each of said filter elements having a first electrode connected to one of said first conductive terminals, a second electrode connected to one of said second conductive terminals, and a grounding electrode connected to said grounding terminal.

3. A connector as recited in claim 2 wherein each of said plurality of first conductive terminals and each of said plurality of second conductive terminals further comprise:

an elastic end for insertion into said concave portion.

4. A connector as recited in claim 2, wherein said filter array includes:

a plurality of inductors as said filter elements.

5. A connector as recited in claim 2, wherein said filter array includes:

a plurality of capacitors as said filter elements.

6. A connector as recited in claim 2, wherein said filter array includes:

a plurality of resistors as said filter elements.

* * * * *